US006712667B1

(12) United States Patent
Melzer et al.

(10) Patent No.: US 6,712,667 B1
(45) Date of Patent: Mar. 30, 2004

(54) ARTICULATED MAGNET ASSEMBLY AND KIT

(75) Inventors: Eric R. Melzer, 3009 Bryant Ave. S., #5, Minneapolis, MN (US) 55408; Craig Williamson, North Riverside, IL (US)

(73) Assignee: Eric R. Melzer, Minneapolis, MN (US)

( * ) Notice: Subject to any disclaimer, the term of this patent is extended or adjusted under 35 U.S.C. 154(b) by 19 days.

(21) Appl. No.: 09/955,922

(22) Filed: Sep. 19, 2001

Related U.S. Application Data

(60) Provisional application No. 60/234,425, filed on Sep. 21, 2000.

(51) Int. Cl.[7] ..... A63H 33/04; A63H 33/26; A63H 3/26

(52) U.S. Cl. ..... 446/92; 446/129; 446/138; 446/376

(58) Field of Search ..... 446/129–139, 446/376, 385, 388, 356, 92, 100, 387, 97; 206/579, 577

(56) References Cited

U.S. PATENT DOCUMENTS

| | | | | |
|---|---|---|---|---|
| 1,544,645 A | | 7/1925 | Johnson | |
| 2,203,128 A | | 6/1940 | Cairo | 46/157 |
| 2,365,098 A | | 12/1944 | Nudelman | 46/157 |
| 3,068,744 A | * | 12/1962 | O'Hara-Wright | 446/337 |
| 3,713,655 A | * | 1/1973 | Goldfarb et al. | 446/139 |
| 3,883,984 A | * | 5/1975 | Champeaux | 446/92 |
| 4,057,247 A | | 11/1977 | Morrison | 273/1 R |
| 4,294,036 A | * | 10/1981 | Wion | 446/135 |
| 4,952,153 A | * | 8/1990 | McAllister | 446/137 |
| 5,152,711 A | * | 10/1992 | Gross | 446/139 |
| 5,178,573 A | * | 1/1993 | Smith | 446/73 |
| 5,386,656 A | | 2/1995 | Bergman | 40/539 |
| 5,458,521 A | | 10/1995 | Todd | 446/73 |
| 5,775,971 A | | 7/1998 | Brown | 446/376 |
| 5,993,218 A | | 11/1999 | Kapell | 434/168 |

OTHER PUBLICATIONS

Alvin & Co., Inc., "Template Designs", *Human Figure Position Template*, available for sale prior to Sep. 21, 2000.
Hog Wild, Inc., packaging and front view of *THE BENDERS*™, available for sale prior to Sep. 21, 2000.
Front and Back side (2 pages) of Ski Figure, available for sale prior to Sep. 21, 2000.
ATA–BOY INC., Front and Back side of Flying Superman magnet, available for sale prior to Sep. 21, 2000.
Caryco Magnets, "*Dress Me Up David*", 1995.
MAGNETIC POETRY INC., "*magnetic poetry*" 1993.

* cited by examiner

*Primary Examiner*—Derris H. Banks
*Assistant Examiner*—Faye Francis
(74) *Attorney, Agent, or Firm*—Kinney & Lange, P.A.

(57) ABSTRACT

The invention is a character object comprising an artistic layer formed of a sheet material. The artistic layer includes a torso having a plurality of articulation points and a plurality of appendages. Each appendage is pivotally connected to the torso at one of the torso articulation points such that each appendage may be pivoted with respect to the torso. At least one magnet is fixed to the artistic layer.

19 Claims, 19 Drawing Sheets

ARTICULATED MAGNET ASSEMBLY AND KIT

This application claims the benefit of Provisional Application No. 60/234,425 filed Sep. 21, 2000 for "Articulated Magnet Assembly Kit" by Eric Meizer, incorporated by reference in its entirety herein.

BACKGROUND OF THE INVENTION

The present invention relates to two-dimensional action figures. In particular, the present invention relates to a game kit having articulatable, posable magnetic action characters using word objects and accessories to create situations which teach or have comic effect.

Magnets are commonly used to affix objects to metallic devices. For instance, papers, pictures, and the like are often attached to a metal refrigerator using magnets. The magnets themselves are often given artistic features by attaching various artistic objects and by decorating, or shaping them to resemble various objects (e.g. vegetables, fruit, picture frames, etc.). Indeed, magnets have become an end to themselves, and are used as decorations and games.

In one specific example, flexible plastic magnets have been used to teach various language skills as well as for recreational purposes. Each individual magnet has a word or word-fragment displayed on one surface. The user attaches the magnets to any ferric surface, and arranges them in some given order. Various poems, epitaphs, or other desirable phrases can be constructed by changing the order of the magnets. This concept has also been used to teach the proper order and meaning of various parts of speech and also to illustrate the humorous and nonsensical effects of readily randomly changing one or more words in a sentence or phrase. However, nothing is provided to "illustrate" the effects of the words (humorous or otherwise).

Action figures which utilize movable joints are also known. For example, U.S. Pat. No's. 2,365,098 and 5,993,218 (incorporated by reference in their entirety herein) disclose cardboard figures having a movable joint. However, the figures disclosed in U.S. Pat. Nos. 2,365,098 and 5,993,218 are limited in the number of lifelike poses which can be simulated (e.g., leaping) since the figures must be supported by the ground. Articulation of the figures is also limited. Thought or speech for the figures cannot be shown and accessory tools (e.g., fishing poles, weapons) cannot be easily attached or associated with the figure to provide a variety of situations in which the figure can be placed.

Prior magnetically applied characters such as "Dressing David," manufactured by Caryco Magnets, lack joints that articulate leaving the consumer limited in their ability to create comical situations with the figures. Without hinged or articulating joints the figures are stagnant and lifeless.

Given the limitations of the prior art, a need exists in the art for posable characters which can create lifelike movement and create interactive situations through poses and implied speech or thought.

BRIEF SUMMARY OF THE INVENTION

The invention is a toy character comprising an artistic layer formed of a sheet material. The artistic layer includes a torso having a plurality of articulation points and a plurality of appendages. Each appendage is pivotally connected to the torso at one of the torso articulation points such that each appendage may be pivoted with respect to the torso. At least one magnet is fixed to the artistic layer.

DETAILED DESCRIPTION

Figure 1:
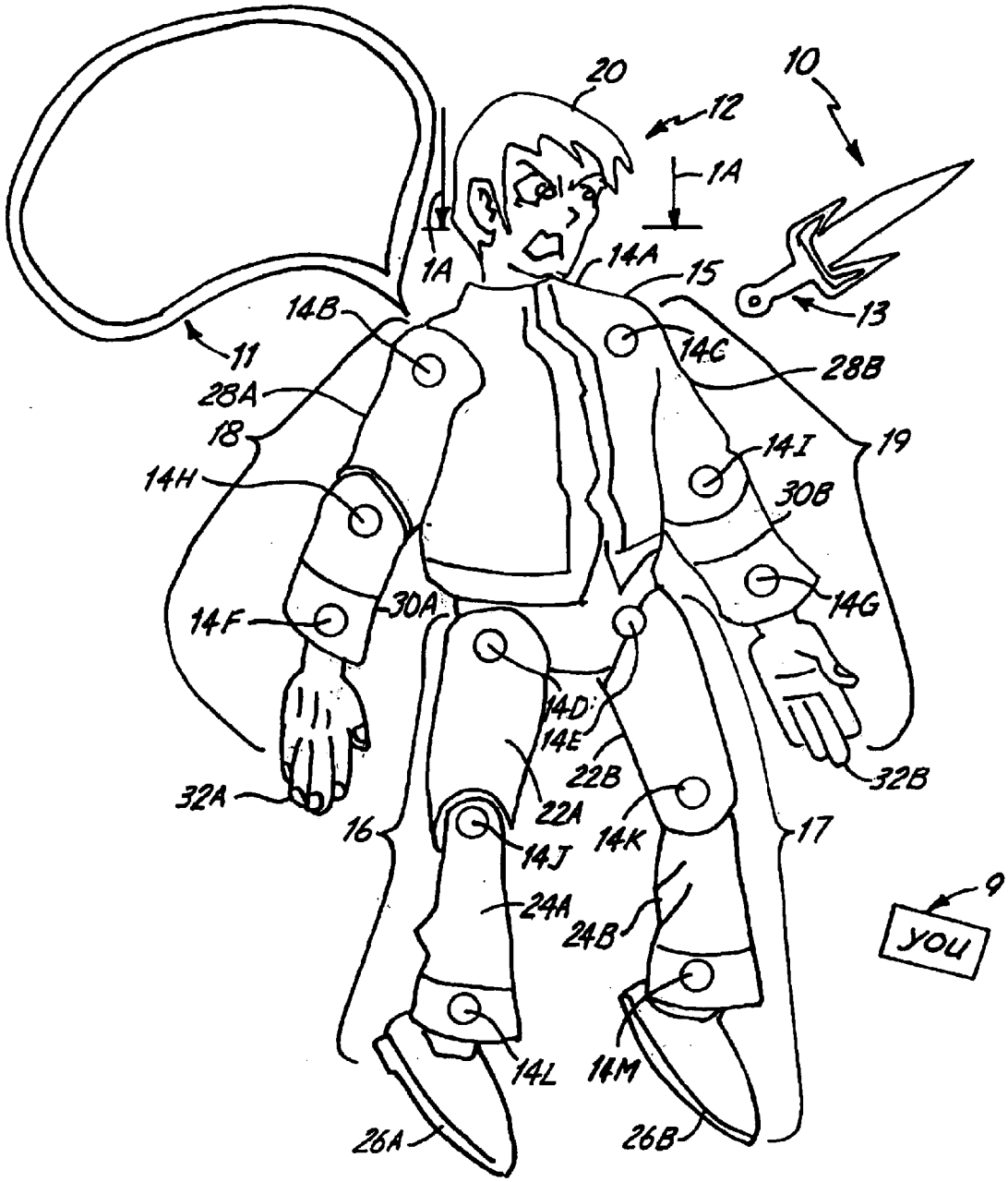
FIG. 1 is a plan view of a first character object.

An inventive toy assembly 10 utilizing a word object 9, a first word bubble object 11, a first character object 12 and an accessory object 13 is shown in FIG. 1. The first character object 12 includes articulation points 14A–14M, a torso 15, a first and second leg appendage 16 and 17, a first and second arm appendage 18 and 19, and a head appendage 20. The first and second leg appendages 16 and 17 each include an upper leg portion 22A and 22B, a lower leg portion 24A and 24B and a foot 26A and 26B. The first and second arm appendages 18 and 19 each include an upper arm portion 28A and 28B, a lower arm portion 30A and 30B, and hands 32A and 32B.

Articulation points 14A–14M are disposed on in the character object 12 to mimic joints in a character's body (e.g. neck, shoulder, elbow, wrist, hip, knee and ankle). The articulation points 14A–14M allow one portion of the character object to rotate (or pivot) with respect to a second portion of the character object 12. Shaping the first character object 12 in a human form and then placing articulation points 14A–14M at various joints allows the first character object 12 to be articulated into various positions. As is illustrated, articulation points 14A–14E are disposed on the torso 15 and are attached to the leg appendages 16 and 17, the arm appendages 18 and 19 and the head appendage 20. All of the appendages (legs, arms and head) can be pivoted with respect to the torso 15 at articulation points 14A–14E. By moving the appendages with respect to the torso 15, the user of character object 12 can create a variety of life-like poses with the character object 12.

More specifically, the life-like characteristic of the character object 12 is furthered by the use of articulation points 14F–14M which are used to segment the appendages so that each appendage segment can be individually articulated. Articulation points 14A–14M can be created using any number of connection systems known in the art, such as rivets, snaps or screws, secured at overlapping portions of each appendage (or member). Alternatively, articulation points 14A–M may utilize a magnetic pivot fastener, as illustrated and described below with respect to FIGS. 1B–1F. Although thirteen articulation points 14A–14M are illustrated with respect to the character object 12 any number of articulation points (generally referred to by reference number "14") may be inserted to provide varying levels of articulation of the character object 12. It should be noted that throughout the specification, like elements of different character objects (e.g., articulation points 14A–14M) are indicated by like reference numbers.

The first character object 12 artistically depicts a "Kung Fu" type cartoon character facing the user. As will be noted with respect to the embodiments described below, each of the various character objects may be presented so as to face any direction with respect to the user, and have any number of articulation points which allow the character object to simulate the movement of a human form. The invention contemplates other character objects depicting other real or imaginary animate forms (e.g. dogs, cats, mice, dinosaurs, space aliens, gnomes, etc.) which may be articulated by disposing articulation points so as to mimic the joints in the depicted form and articulating them into various poses.

Figure 1A:
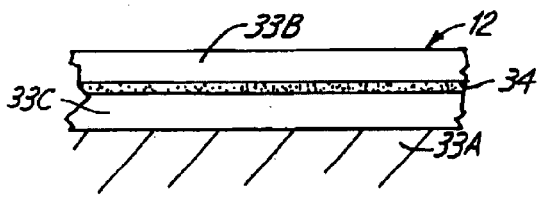
FIG. 1A is a partial cross-sectional view of the character object as taken along lines 1A—1A of FIG. 1.
Figure 1B:
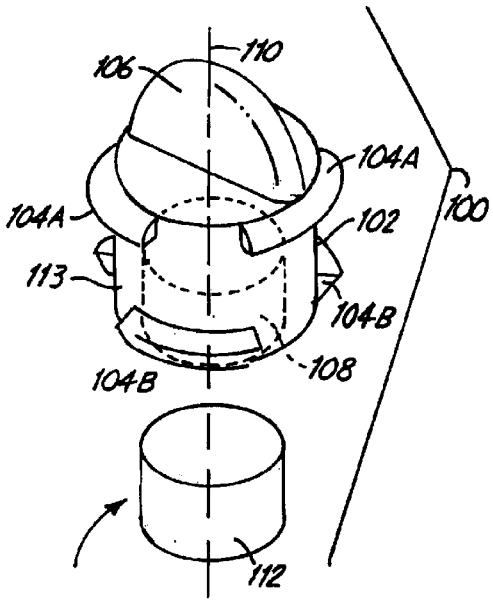
FIG. 1B is a perspective view of one embodiment of a pivot fastener.

As shown in FIG. 1A and exemplified using the first character object 12, the objects of the present inventive assembly 10 are placed on a ferric surface 33A (such as a refrigerator). In one embodiment, each object is formed by applying an artistic layer 33B to a magnetic layer 33C. The artistic layer 33B may be formed of a sheet material such as paper, plastic, lithographic sheets, or other material which is lightweight, durable and can receive and retain printing on its outer surface. In one embodiment, the artistic layer 33B is bonded to the magnetic layer 33C using a pressure sensitive adhesive 34, or other bonding method such as would be known to a person skilled in the art. The magnetic layer 33C releasably fixes the character object (e.g., first character object 12) in place on the ferric surface 33A by magnetic attraction. The magnetic layer 33C may be flexible or stiff depending upon the desired performance characteristics of the object being manufactured. Since the character object 12 is magnetically fixed, it can be easily repositioned many times or in any position allowed by the articulation points 14. This ease of positioning is in contrast to previous non-magnetic systems which had articulation mechanisms. These systems would not fix the object in place since repositioning the prior systems would cause the fixing mechanism to wear and gradually fail (e.g., adhesives).

In the present invention, the character objects can be repositioned any number of times by the user to create a large number of varying poses. Additionally, the user may place the character objects in different situations by juxtaposing multiple character objects or other objects (e.g., accessory objects) next to the character objects (described further below). As mentioned above with respect to the embodiment illustrated in FIG. 1A, the various objects (e.g., accessory, character, word bubble and word which can be used in any combination or number) of the inventive assembly 10 utilize the magnetic layer 33C to maintain the position of the individual objects on the ferric surface 33A. Another advantage of using magnetic attraction to position the various objects is that objects may be placed on top of each other, and will still maintain their spacial position due to magnetic attraction to the ferric surface 33A.

In an alternate embodiment for articulated objects (e.g., first character object 12), no magnetic layer 33C is necessary. Instead, the artistic layer 33B (e.g., sheet material) is mounted onto any base material (e.g., chip board or paperboard). The objects utilize magnetic pivot fasteners, an example of which is illustrated at 100 in FIG. 1B, to both articulate the characters as well as maintain the posed position of the characters. The magnetic pivot fastener 100 includes an annular casing 102 and a series of top and bottom annular collars 104A and 104B disposed about the plastic casing 102. A tab 106 is optionally disposed at one longitudinal end of the annular casing 102 and an aperture 108 extends into the annularcasing 102 from the opposite longitudinal end along a longitudinal axis 110 of the annular casing 102. A permanent magnet 112 is press fit and/or is glued into the aperture 108.

The annular casing 102, top and bottom annular collars 104 and tab 106 are poly-vinyl chloride (PVC), or some other polymeric material injection molded so as to form one integral piece with the aperture 108. Preferably the magnet 112 is substantially the same size and shape as the aperture 108 in order to assure that the magnet 112 is securely fixed within the plastic casing 102. Preferably, the magnet 112 has a diameter of approximately 0.3 inches and a length of approximately 0.3 inches. The magnet 112 is preferably disposed entirely within the aperture 108.

The outer diameter of the plastic casing 102 is preferably approximately 0.375 inches. As shown in the cross-sectional view illustrated by FIGS. 1C and 1D, top and bottom annular collars 104A and 104B extend radially outward proximate to each longitudinal end of the annular casing 102 from an outer surface 113 on the annular casing 102. The collars 104A and 104B preferably extend at an angle of approximately 30 degrees (arrow 114) from the outer surface 113, and longitudinally along the outer surface 113 for approximately 0.1 inches (indicated by arrows 116). A distance of preferably approximately 0.2 inches (indicated by arrows 118) separates collars 104A and 104B. Collars 104A and 104B provide a means for interconnecting the articulated pieces (illustrated using torso 15 and first leg appendage 16). The magnetic pivot fastener 100 allows each articulated member (e.g., torso 15 and first leg appendage 16) to pivot with respect to the other member.

To assemble an object, the user grasps the tab 106 of the magnetic pivot fastener 100 and inserts the pivot fastener 100 through a hole pre-formed at an articulation point in two (or possibly more) appendages and/or torso members. Additionally, other objects (such as accessory objects) may have articulation points which can be secured using pivot fasteners. Any two pieces (i.e., articulated members, torsos or objects) can be connected together, creating a "modular" type assembly which gives the user multiple options as to which pieces of a given character are to be joined. The magnetic pivot fastener 100 can be universal across any objects (e.g., character objects) included with the assembly and can therefore be used to join pieces from any of the characters together (i.e., the head from one character object can be attached to the body of a different character object). The modular nature of this embodiment also allows the user to disassemble and reassemble objects so as to create multiple variations for each object. It should be understood that including tab 106 as part of pivot fastener 100 is optional. Tab 106 is included so as to allow the operator to better grasp pivot fastener 100.

Additionally, due to the inclusion of magnet 112 in aperture 108 the magnetic pivot fastener 100 provides magnetic attraction to any ferric surface, and eliminates the need for a separate magnetic layer (as described with respect to FIG. 1A above). The magnetic pivot fastener 100 can also be easily inserted and removed from articulation points, allowing assembly and disassembly of the character object for storage or creating new objects. The integral construction of the pivot fastener 100 also eliminates excess parts which could be lost during use and allows for an efficient manufacturing process of the inventive assembly 10, while still providing the same repositionable characteristics to the objects as was described previously with respect to the magnetic layer illustrated in FIG. 1A.

Figure 1E:
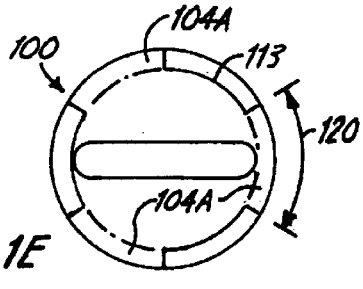
FIG. 1E is a top view of a one embodiment of a pivot fastener.
Figure 1C:
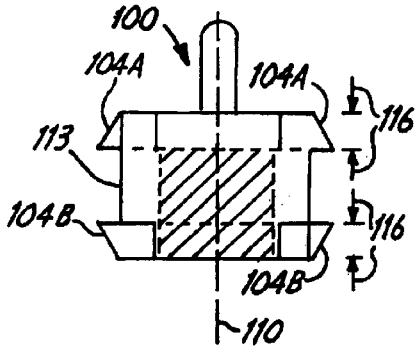
FIG. 1C is a cross-sectional view of one embodiment of a pivot fastener.
Figure 1D:
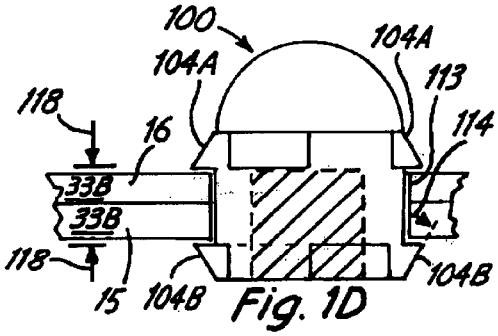
FIG. 1D is a cross-sectional view of one embodiment of a pivot fastener.
Figure 1F:
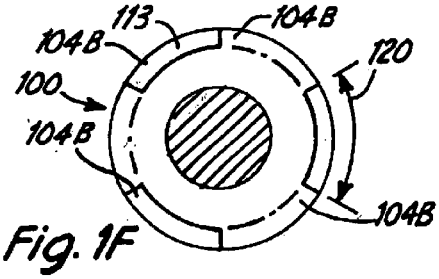
FIG. 1F is a bottom view of one embodiment of a pivot fastener.

As illustrated in FIG. 1E, each annular collar 104A on the top end of the plastic casing 102 and each annular collar 104B on the bottom end of the plastic casing 102 preferably extends for approximately 60 degrees (arrows 120) about the outer surface 113 of the plastic casing 102. Preferably, three annular collars 104A are disposed about the top end (one longitudinal end) and spaced equidistant from each other. Three annular collars 104B are disposed about the bottom end (the other longitudinal end) and spaced equidistant from each other. The resulting configuration provides a 60 degree spacing between the collars 104A on the top end, and a 60 degree spacing between the collars 104B at the bottom end. Additionally, the collars on the top end 104A are offset from the collars on the bottom end 104B such that where a space is provided between collars on the top end 104A (e.g., from 60 degrees to 120 degrees), a collar is disposed at the bottom end at the same annular position (e.g., from 60 degrees to 120 degrees), and vice versa. This particular configuration allows the pivot fasteners 100 to interconnect the articulated appendages and torsos (or collectively "members") of the objects without damaging the materials forming the members (typically printed lithographic sheets mounted on chipboard). Each member in the magnetic pivot fastener embodiment illustrated at 100, in FIGS. 1B–1F is typically approximately 0.08 inches thick. It should be noted that although the invention describes a separate sheet used as the artistic layer, printing the artistic layer directly onto the magnet or base material is also contemplated.

In yet another alternate embodiment of the inventive assembly 10, suction cups can be secured to the artistic layer 33B, eliminating the need for the magnetic attraction and allowing the objects of the inventive assembly 10 to be secured to non-ferric surfaces. Utilizing suction cups maintains the capability of the objects to be articulated by the operator into a large number of varying poses.

Figure 2:
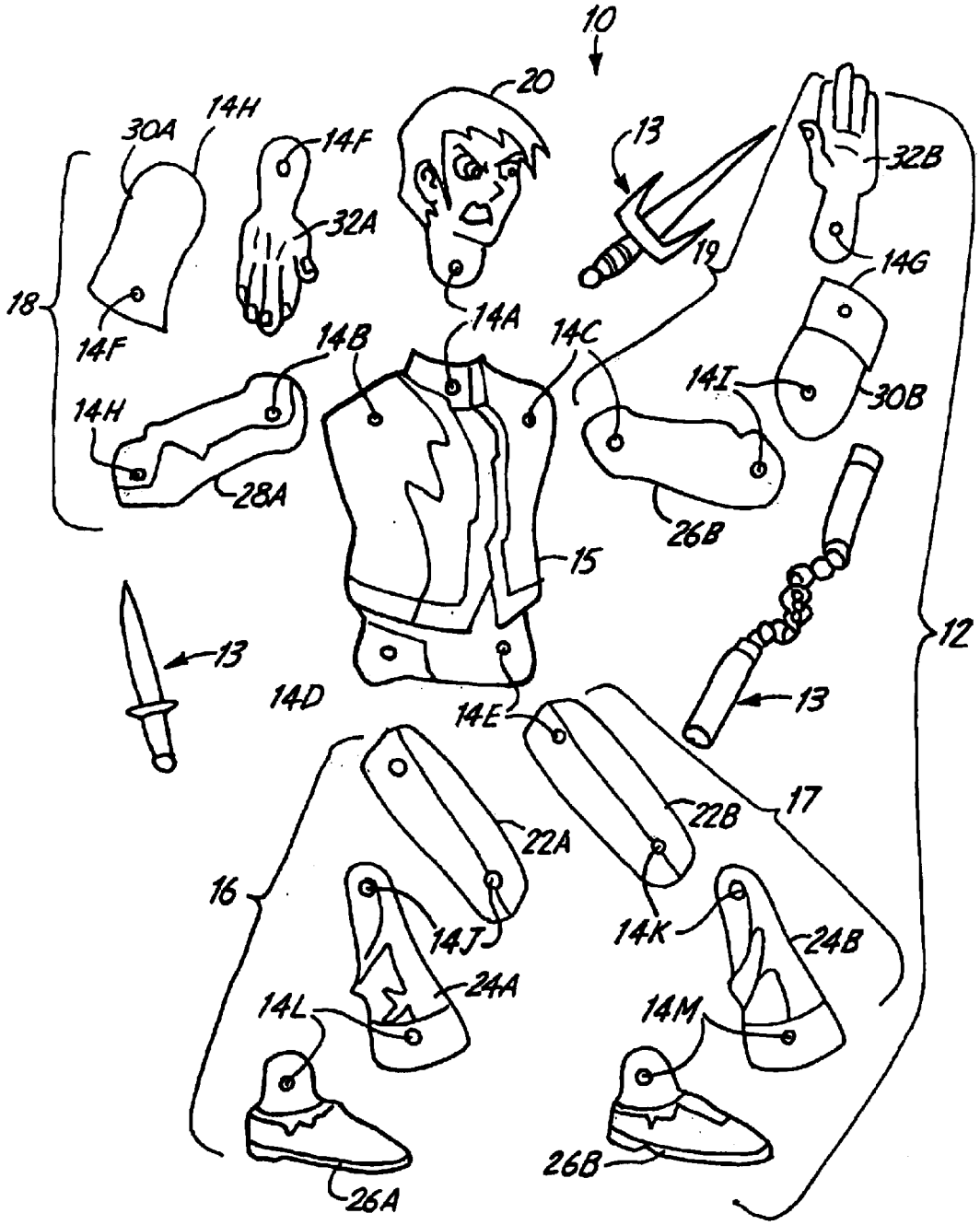
FIG. 2 is a disassembled plan view of the first character object.
Figure 3A:
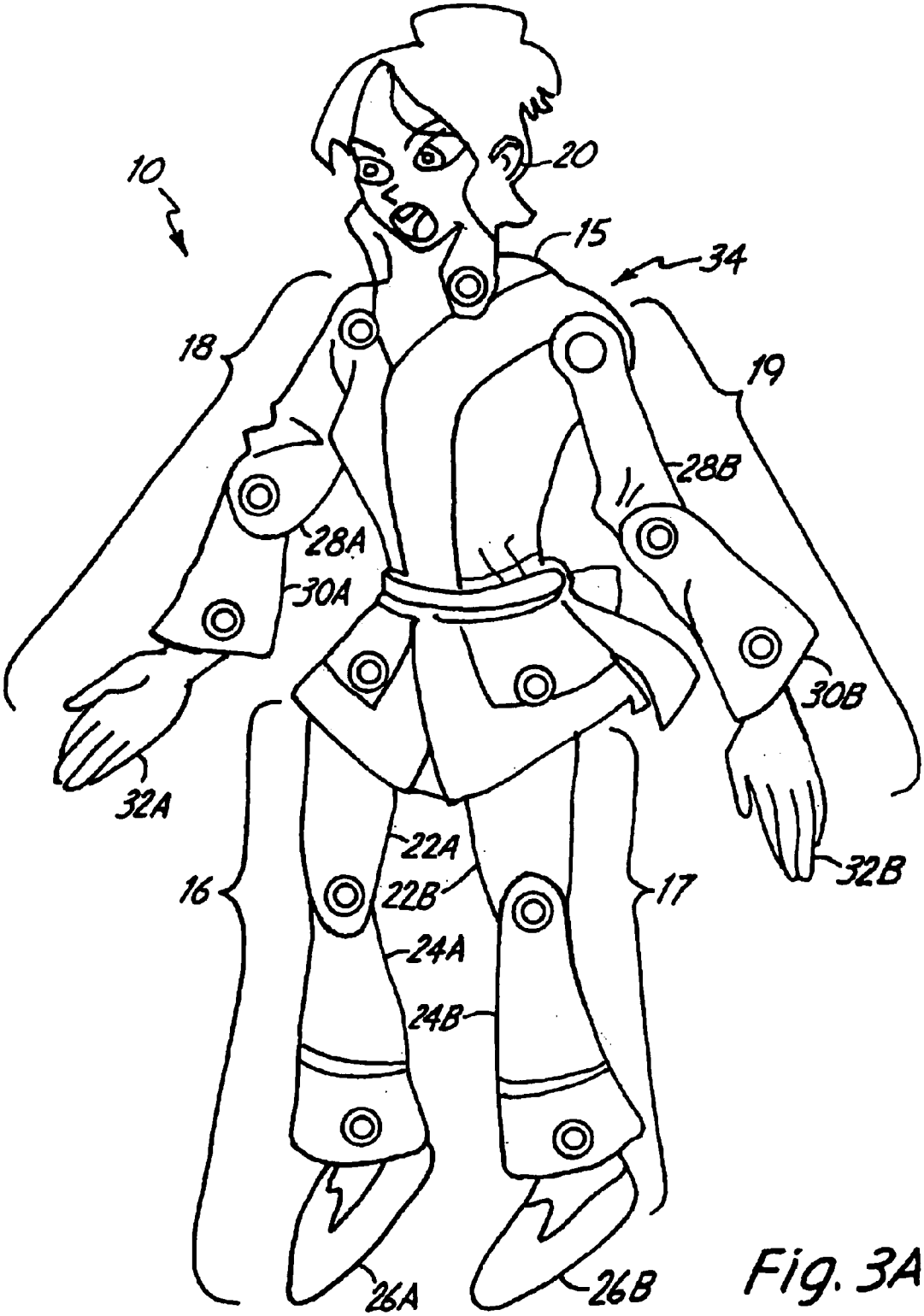
FIG. 3A is a plan view of a second character object.
Figure 3B:
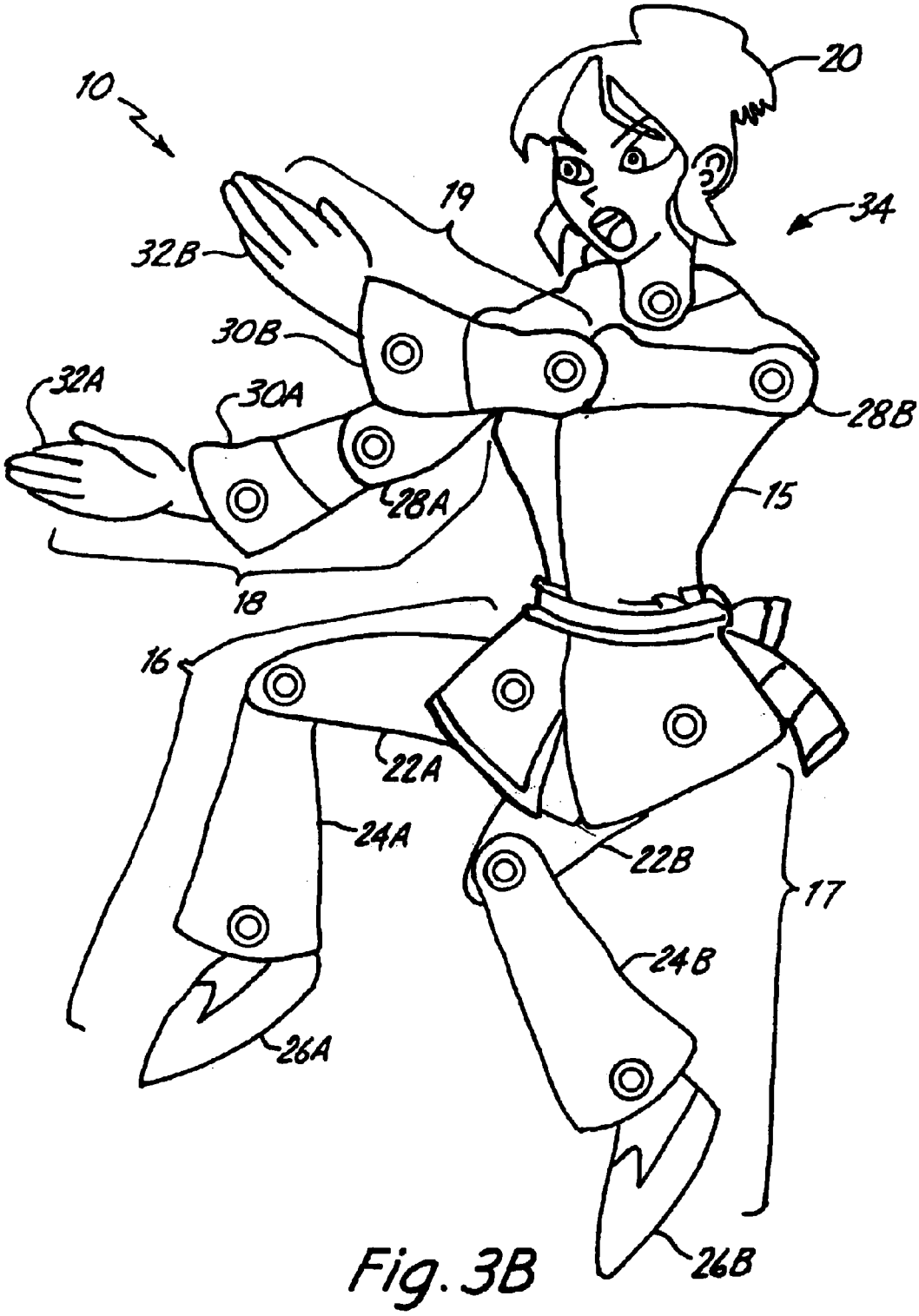
FIG. 3B is a plan view of the second character object in another pose.

FIG. 2 shows a disassembled view of the first character object 12, illustrating the articulation points 14A–14M and the multiple segments used to form the first and second leg appendages 16 and 17 as well as the first and second arm appendages 18 and 19. FIG. 2 additionally illustrates how the articulated objects may be provided to the user in "reattachable" form. By providing the segments of each object in an unassembled form, the user can make a game of assembling the objects, even mixing segments from different objects to arrive at their own object variations, The ability of the user to articulate the character objects into various positions is illustrated in FIGS. 3A and 3B, and exemplified using a second character object 34. The second character object 34 has been placed into a different pose in FIG. 3A from that shown in FIG. 3B which, when viewed sequentially, (e.g., in video or computer form) could be construed as movement (e.g., fighting movements or a dance). Arm appendages 18 and 19 and leg appendages 16 and 17, have been repositioned and internally articulated (e.g., the lower and upper leg portions 24A, 22A and the foot 26A which make up the first leg appendage 16 have been repositioned from the pose shown in FIG. 3A to that shown in FIG. 3B). It should be noted that the same reference numbers are used for the like elements making up the first character object 12 and second character object 34.

Figure 4:
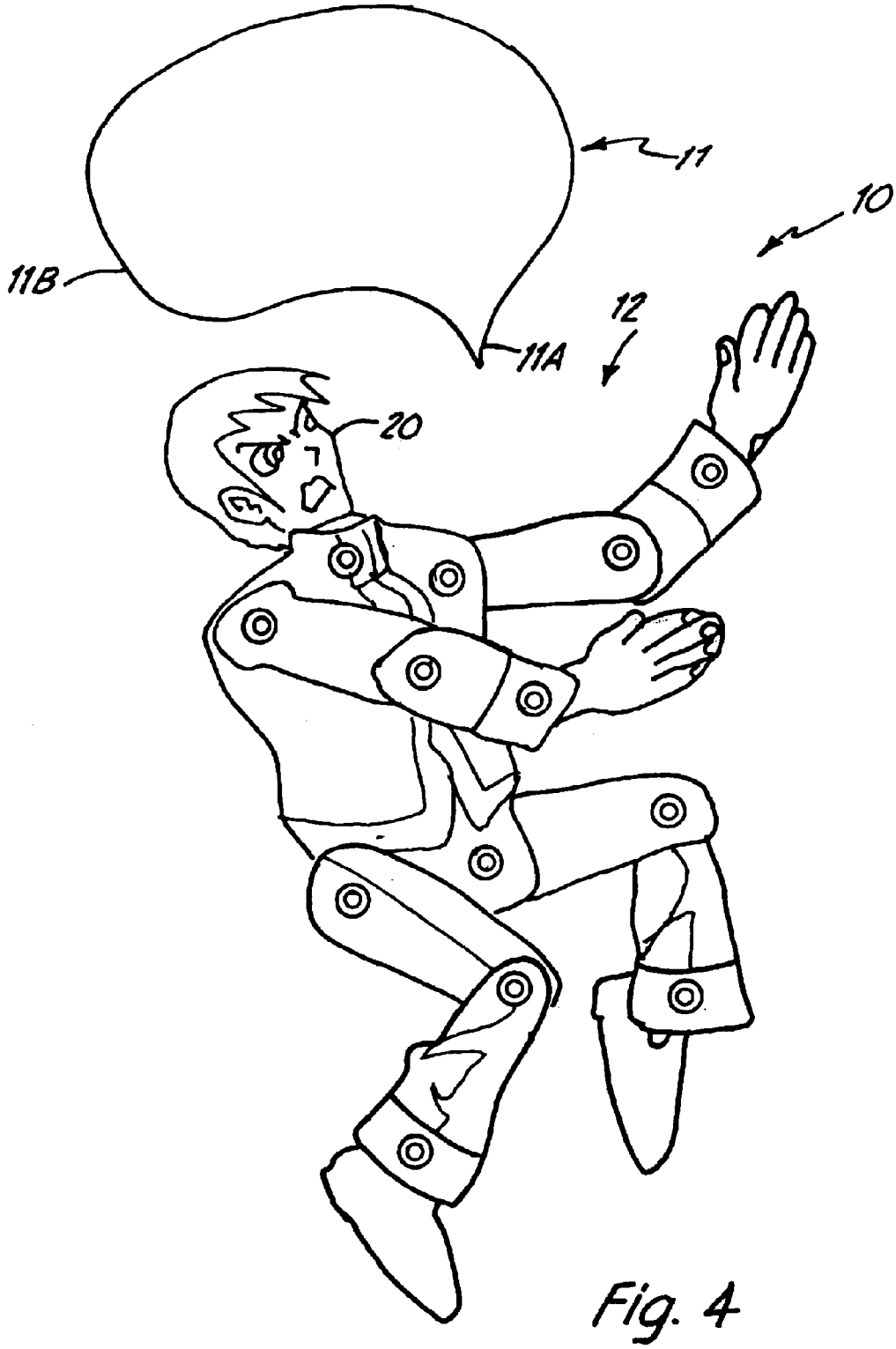
FIG. 4 is a plan view of the first character object with a word bubble object of the inventive kit.
Figure 4A:
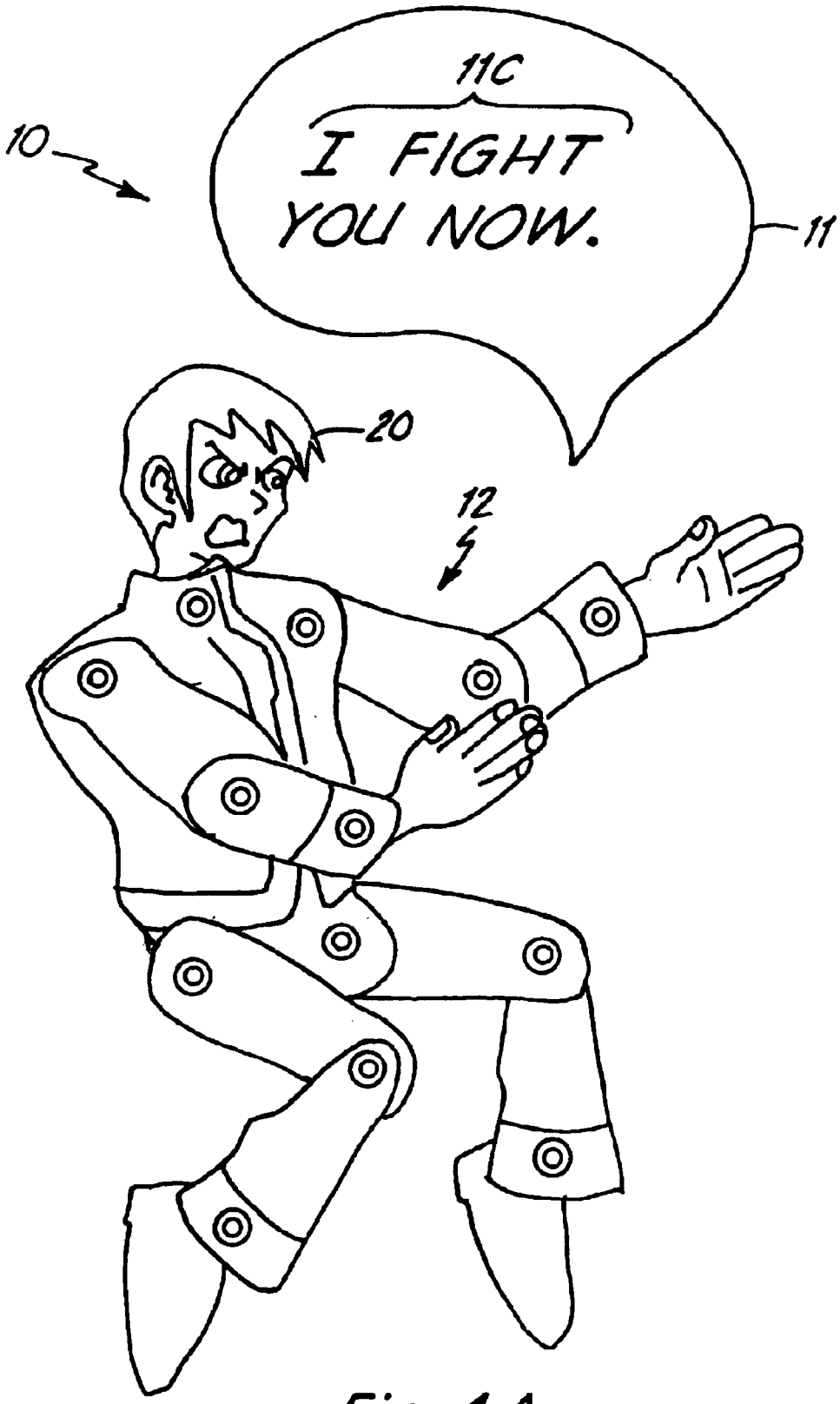
FIG. 4A is a plan view of the first character object with a word bubble object of the inventive kit.

FIG. 4 shows the first character object 12 of the inventive assembly 10. In addition, the first word bubble object 11 has been placed proximate the first character object 12 near the head appendage 20 of the first character object 12 so as to imply the character object 12 is speaking. This technique is known and applied in many comic applications (e.g. newspaper comic strips). Although the first word bubble object 11 is shown as having a generally circular shape with a triangular point 11A extending from a circular portion 11B, a person skilled in the art would realize that other shapes may be used to achieve the same effect (e.g. multiple increasing sized circles implying "thoughts" of the character object). While a single word bubble object 11 is illustrated, any number of word bubble objects (as well as accessory objects, character objects and word objects) can be included with the inventive assembly 10. An erasable pen, pencil or marker, (not shown) may be used to write messages 11C on the word bubble object 11 and may also be included as part of the assembly 10. As illustrated in FIG. 4A, writing on the bubble objects can be facilitated by forming the artistic layer 33B of an easily erasable-plastic material. The user can then erase the written message 11C and rewrite a different message to imply a new "thought" or spoken word by each character object. The user may also simultaneously repose the character object.

Figure 4B:
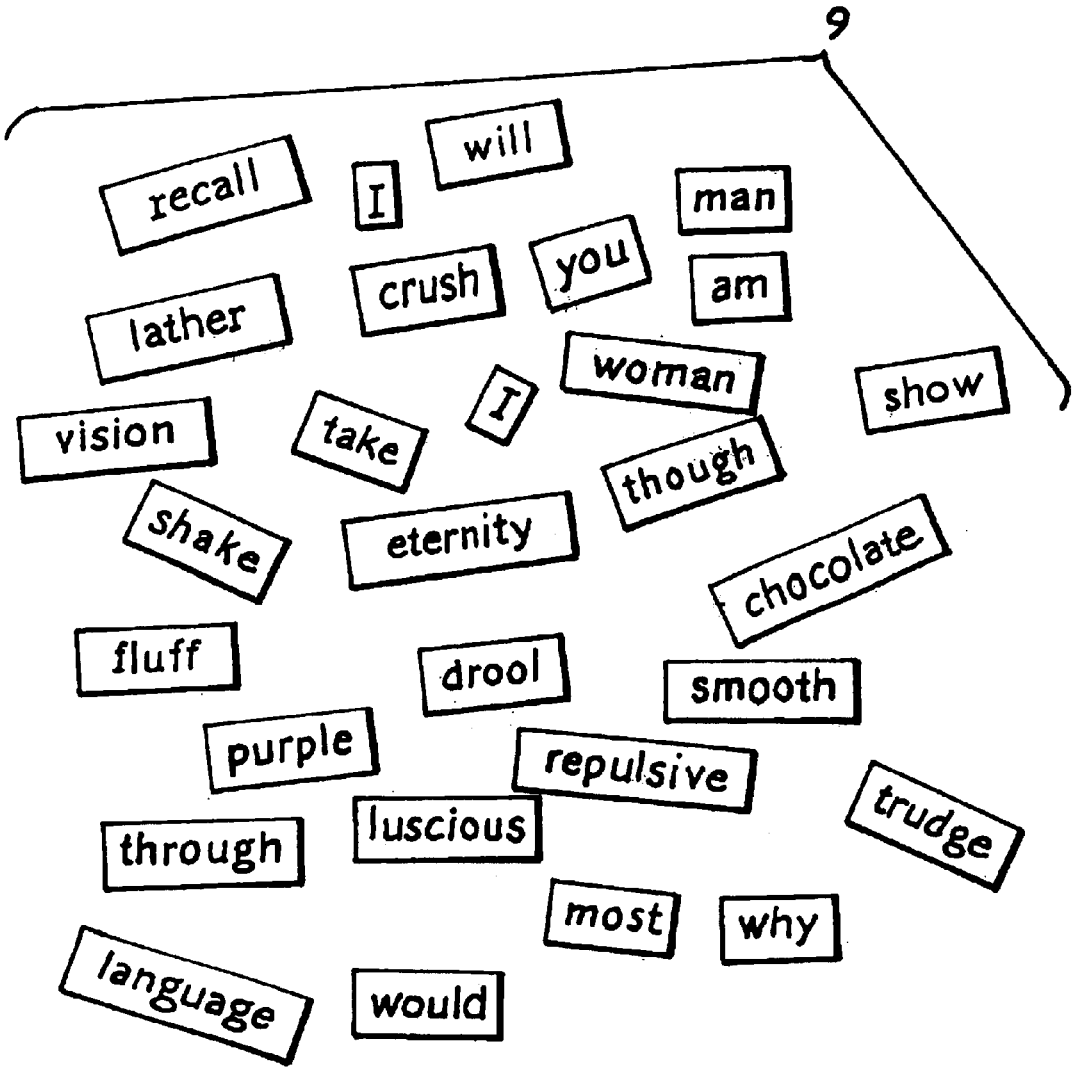
FIG. 4B is a plan view of exemplary word objects of the inventive kit.
Figure 5:
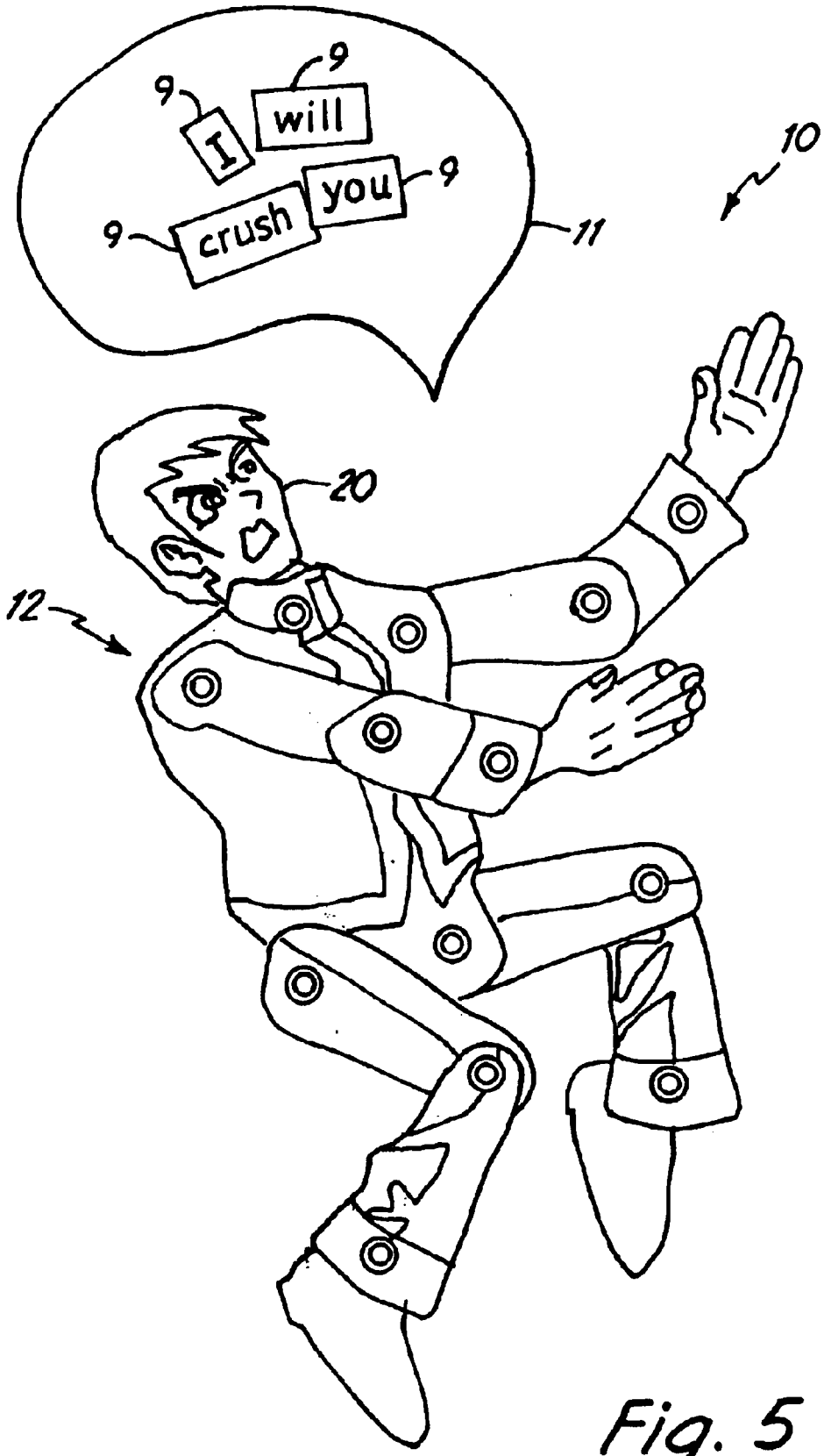
FIG. 5 is a plan view of the first character with a word bubble object and word objects.

Word objects 9 are shown in FIG. 4B. Each word object 9 preferably has a single word or word fragment printed on its surface. The user may position each word object 9 into any given order. These types of magnetic multiple word objects are commercially available in kit form, one example being the Magnetic Poetry Kit® manufactured by Magnetic Poetry Inc., Minneapolis, Minn. An alternate magnetic word object embodiment would be of the type described in U.S. Pat. No. 5,993,281 (Kapell) incorporated by reference in its entirety herein. As shown in FIG. 5, individual word objects 9 can be layered on top of the word bubble object 11 placed near the head appendage 20 of the character so as to imply speech by the character object (here shown as first character object 12). Alternately, the word objects 9 may be placed beside the character object 12 and not layered on the word bubble object 11. This technique may be used to describe the character object 12 or the situation surrounding the character object 12.

Figure 6:
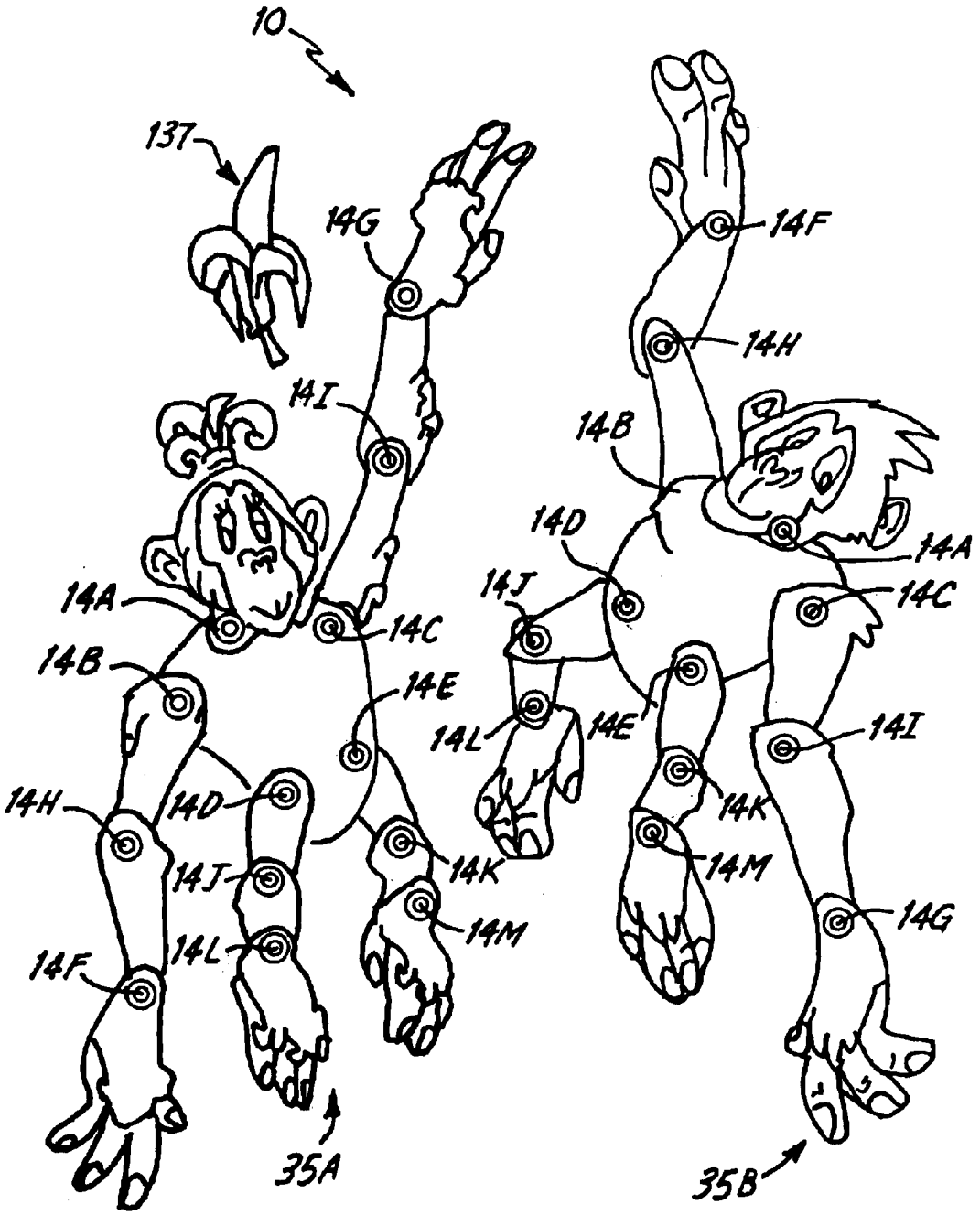
FIG. 6 is a plan view of animal character objects.
Figure 7:
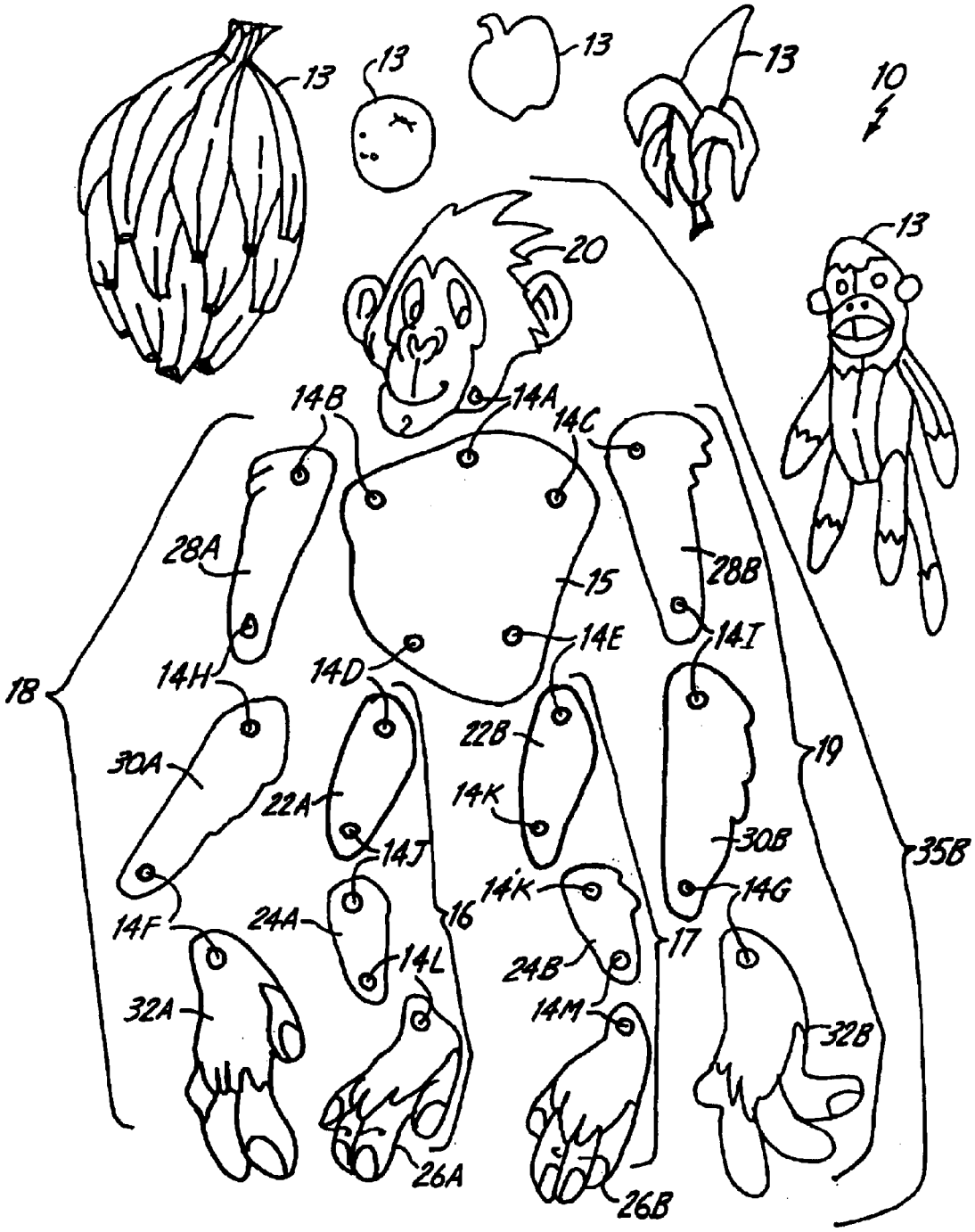
FIG. 7 is a disassembled plan view of one animal character object.

Animal character objects 35A and 35B are shown in FIG. 6. Similar to the previously described human shaped character objects, the animal character objects 35A can be articulated using articulation points 14A–14M so as to imply a gesture, motion or reaction to a situation. Please note that the same reference numbers are used for like elements between the character objects (e.g., animal character objects 35A and 35B and the first and second character objects 12 and 34). While the same number of articulation points and articulatable members are shown, it should be understood that the number of articulation points and articulatable members can vary without departing from the spirit and scope of the invention. An exploded view of the animal character object 35B is shown in FIG. 7 illustrating articulation points 14A–14M which allow the user to position the character object 35B into a variety of poses. As discussed previously, using reattachable magnetic pivot fasteners would allow pieces from different character objects to be, for example, the head appendage 20 from animal character object 35B (a monkey) may be put on the torso 15 of first character object 12 (Kung Fu fighter), as a creative game or for a comedic effect.

Figure 7A:
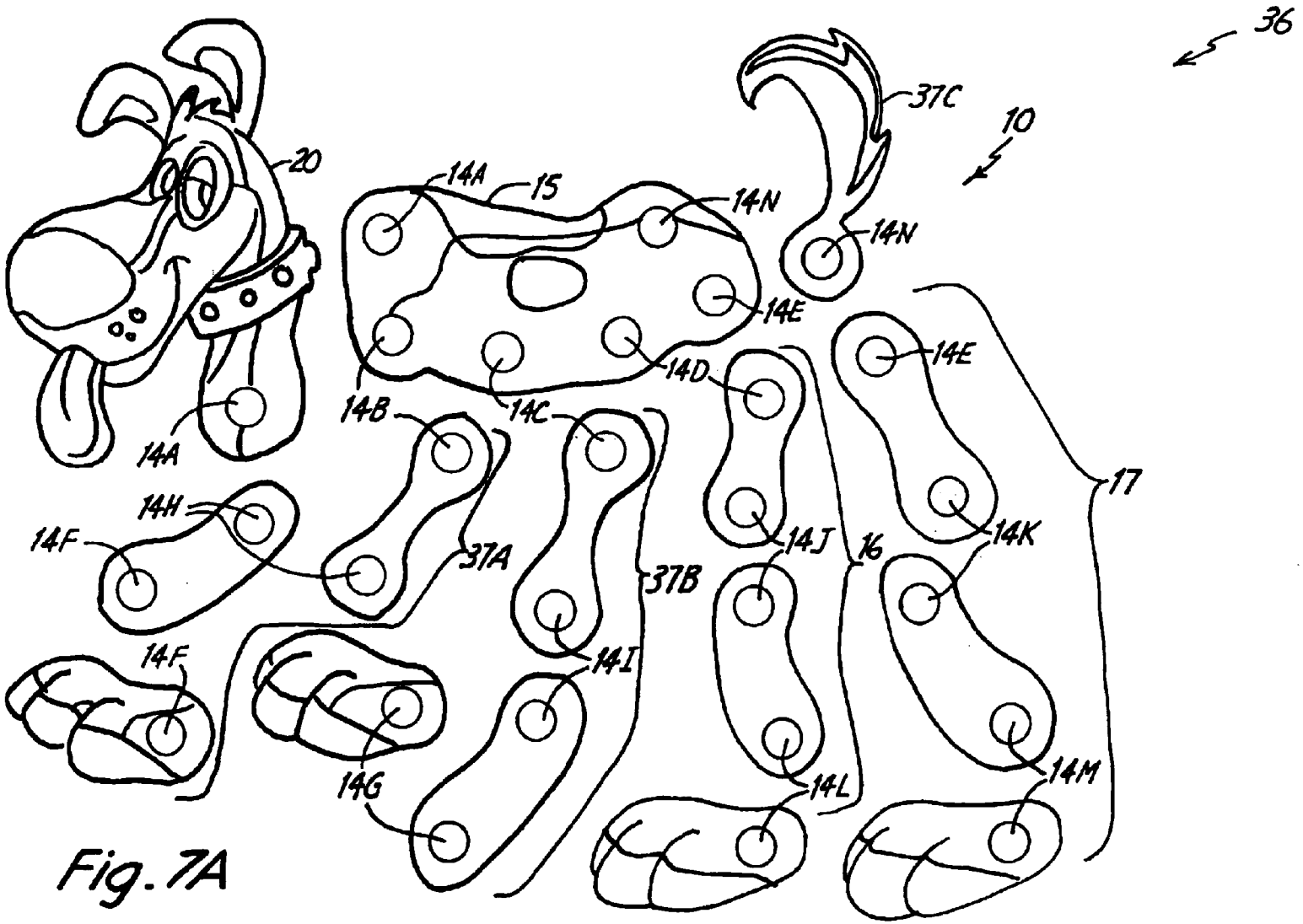
FIG. 7A is a disassembled plan view of a dog character object.

A dog character object 36 is illustrated in disassembled form in FIG. 7A. Again, similar to the human shaped character objects and animal shaped character objects, the dog character object 36 is posed using articulation points 14A–14N. In addition to the head appendage 20, torso 15 and first and second leg appendages 16 and 17, the dog character object includes third and fourth leg appendages 37A and 37B, along with a tail appendage 37C. As previously discussed, the dog character object 36 can utilize a magnetic layer mounted to each member, or alternatively can utilize reattachable magnetic pivot fasteners to mount it to a ferric surface.

Figure 8:
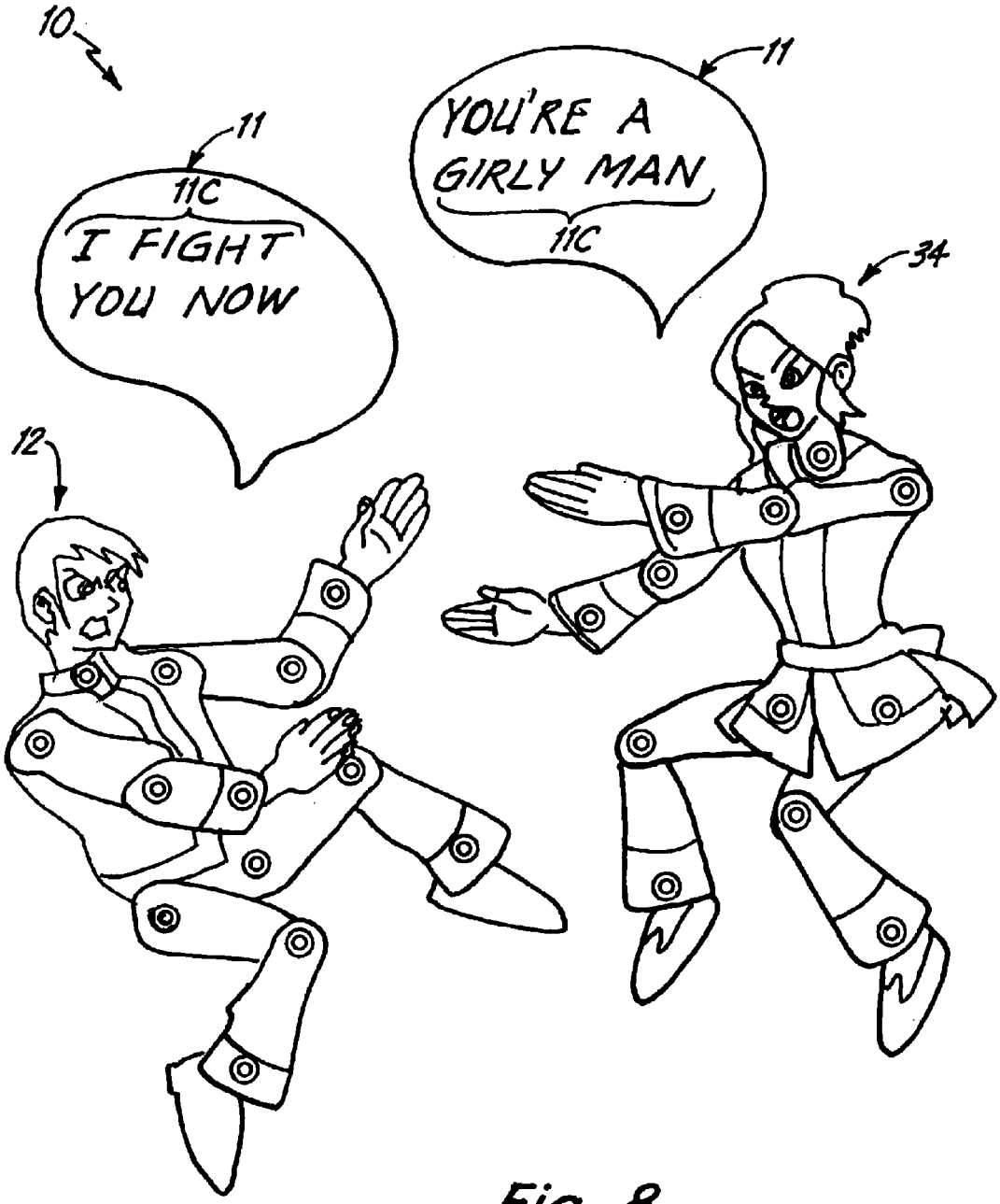
FIG. 8 is a plan view of the first character object and the second character object with word bubble objects.
Figure 9:
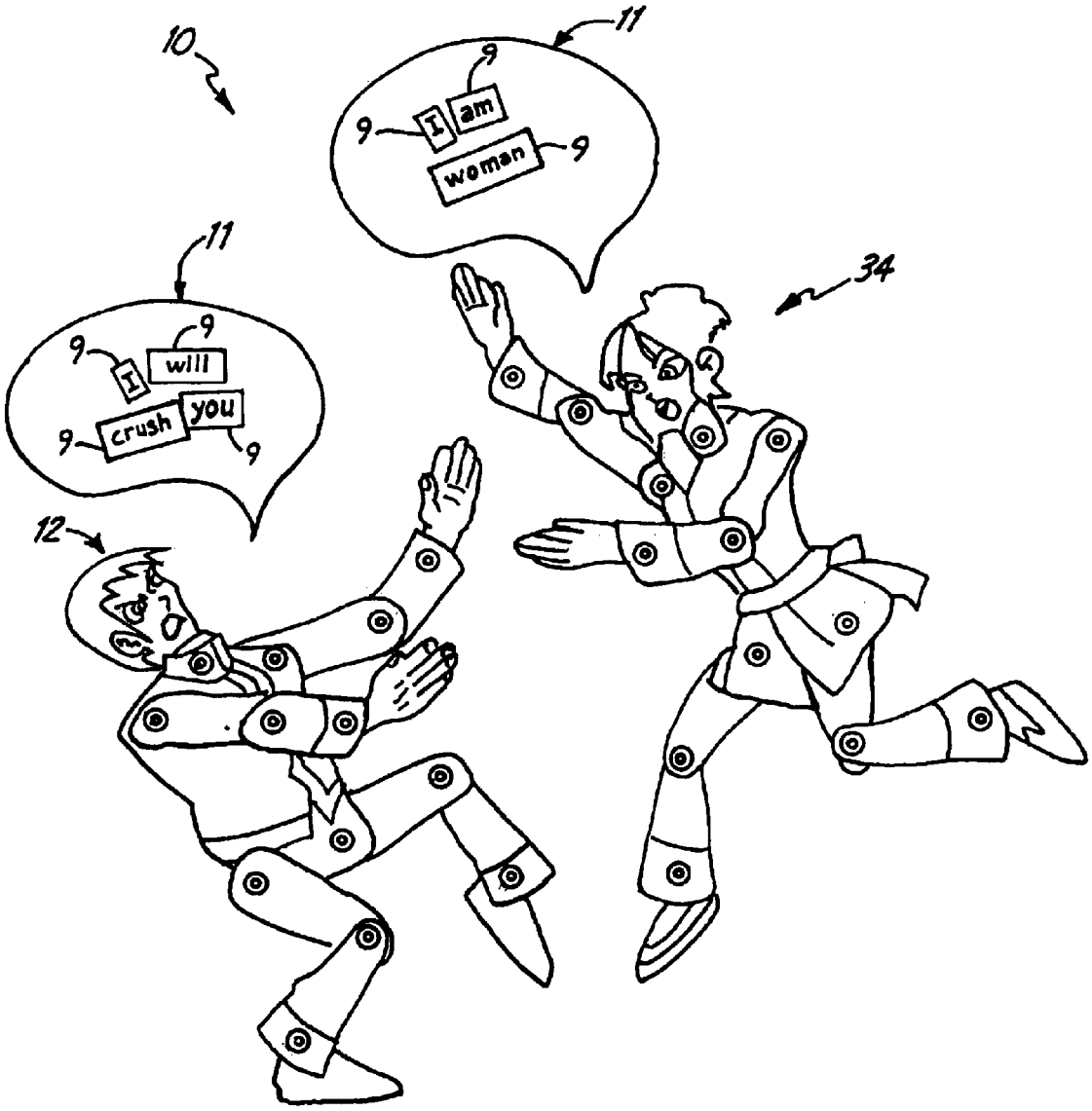
FIG. 9 is a plan view of the first character object and the second character object with word bubble objects and word objects.

The second character object 34 is shown posed with the first character object 12 in FIG. 8. By placing two character objects 34 and 12 next to each other and articulating them into different poses, a situational interaction can be suggested between the second and third character objects 34 and 12. For example, it could be implied that the character objects 34 and 12 are fighting, dancing, singing, or any other number of actions. By placing word bubble objects 11 next to each of the character objects 34 and 12, it is implied that the character objects 34 and 12 are speaking to each other. The speech of each character is provided by the user. This can be accomplished by writing messages 11C on the erasable surface of the word bubble objects 11, or placing word objects 9 on the word bubble objects 11, as shown in FIG. 9. The word objects 9 can be supplied with assembly 10 or provided separately. The user implies situational interaction between first and second character objects 34 and 12 (here depicted as Kung Fu fighters) by placing word objects 9 inside the word bubble objects 11 to provide speech (or thought) to the character objects 34 and 12.

The character objects can be artistically designed to reflect certain situational interactions. As illustrated in FIGS. 1, 2, 3A, 3B, 4, 4A, 5, 8 and 9, Kung Fu characters and their associated weapons can be included as part of the inventive kit 10, while in FIGS 6 and 7, monkey characters along with bananas and other props may be included as part of an inventive kit 10. In one alternate embodiment, a creative group might design an entire group of articulated comic or folkloric characters. For example, character objects depicting Midwestern characters Ole, Toivo and Lena which might come in a package with situation magnets and props (e.g., an ice fishing hole and ice fishing poles to create an ice fishing situation). The consumer could write dialogue above the character's heads in the erasable magnetic cartoon speech bubbles (or use word objects with or without speech bubbles) to create comics about the region they live in. Thus, a full comic or educational situation can be created by the user from an unlimited variety of character, accessory, word bubble and word objects included in the inventive assembly 10.

Figure 10:
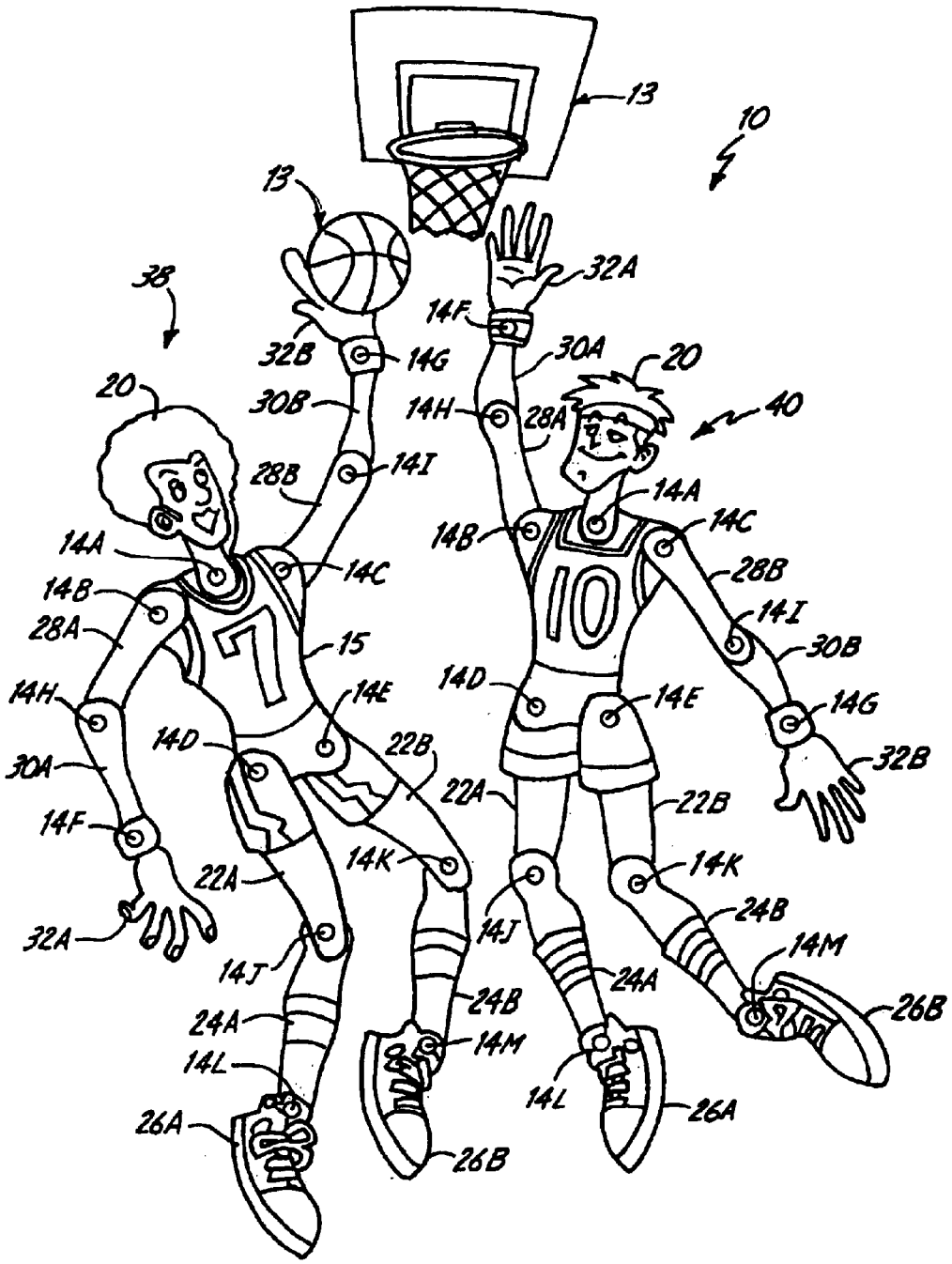
FIG. 10 is a plan view of a third character object and a fourth character object with accessory objects.

Any number and variety of accessory objects 13 can be provided as part of the inventive assembly 10 as further illustrated in FIG. 10. Third and fourth character objects 38 and 40 can be articulated and juxtaposed with accessory objects 13 so that it seems they are using the accessory objects 13. As is illustrated, the accessory objects 13 can include basketball hoops and balls with character objects 38 and 40 artistically depicting and articulated as basketball players in a basketball game. Previously depicted situations such as Kung Fu fighters can include accessory objects depicting weapons as accessories such as knives, swords, nunchucks (as illustrated in FIGS. 1 and 2) or other war-like objects if the "Kung Fu" character objects (character objects 12 and 34 illustrated previously) are articulated in a manner so as to suggest they are fighting. The number of objects which may be used as accessory objects 13 can vary greatly. Additionally, it should be noted that all the objects described herein can be combined between situations, further allowing various creative or comedic effects (e.g., articulating a Kung Fu fighter with a basketball).

Figure 11:
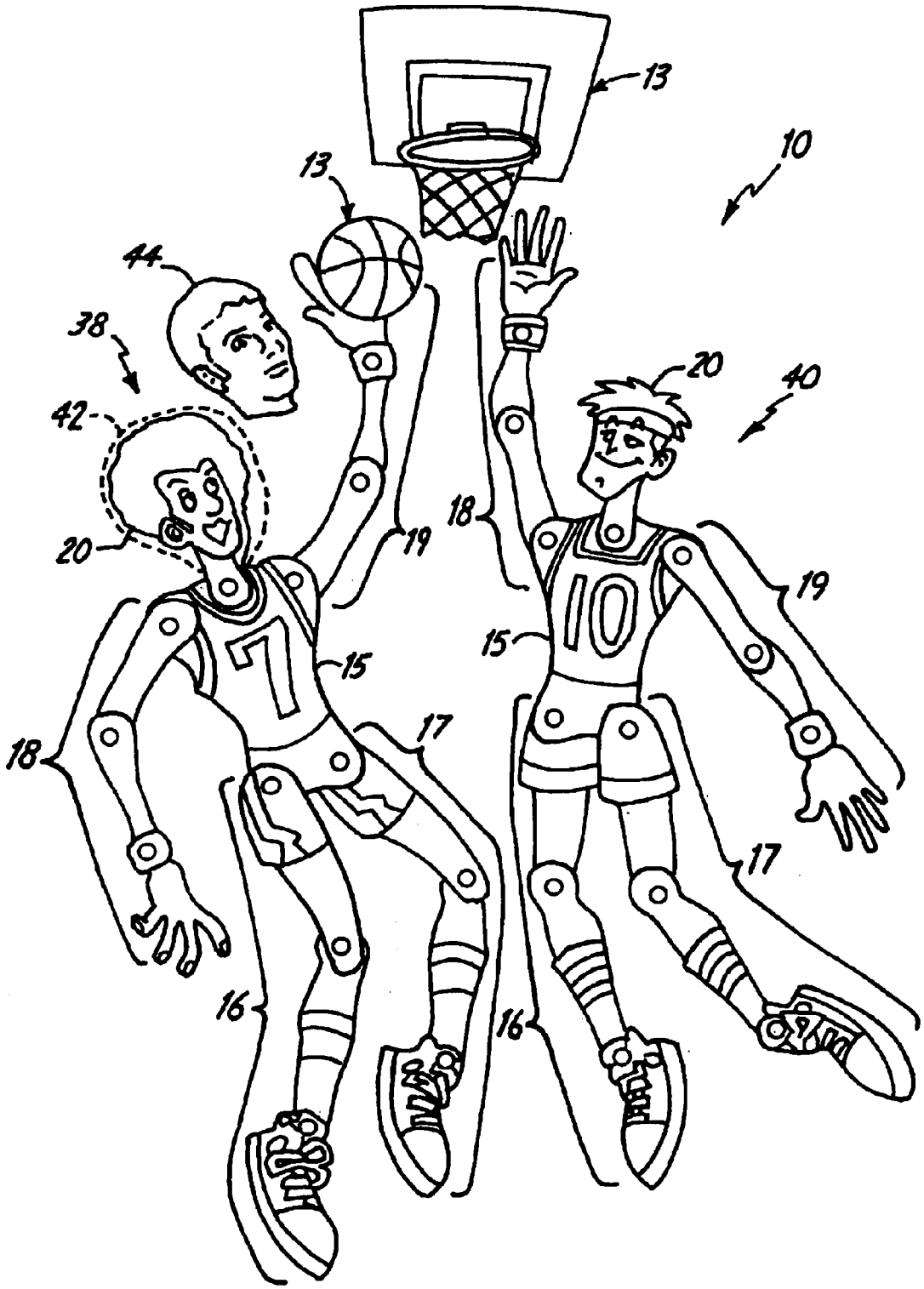
FIG. 11 is a plan view of the third character object and the fourth character object with accessory objects.
Figure 12:
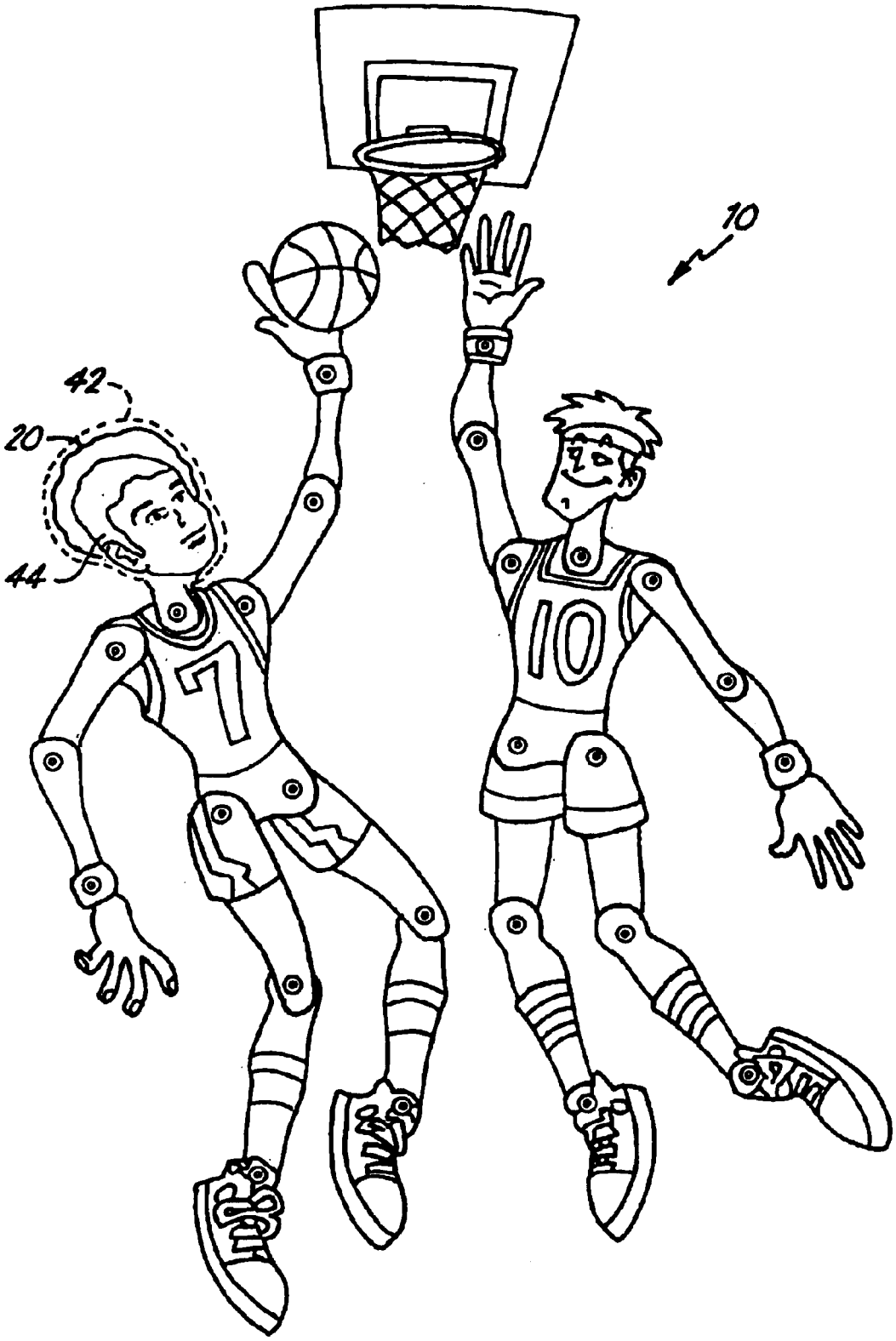
FIG. 12 is a plan view of the third character object with the fourth character object with accessory objects.

As shown in FIGS. 11 and 12, the characters might also be designed with an optional small transparent plastic pocket 42 (shown in dotted lines) over the head appendage 20 of a character object (e.g., third character object 38) where the user can insert a picture 44 (or artwork) of their own creation to further personalize the character object.

The situational themes illustrated in the discussed FIGs. are only a beginning to the numerous and varied themes and promotions which could be developed using the inventive assembly. For example, an assembly incorporating articulated magnetic devil and angel figures as character objects with accompanying erasable magnetic word bubble objects could be created for use on a ferric surface above the right and left shoulders of a person in a photograph so as to suggest the difficulty they are having making a decision. An assembly incorporating articulated figures of the Greek Gods as character objects with harps, pan flutes, togas, and wine vessels as accessory objects might be created for use as an educational tool for students studying Greek mythology. An assembly incorporating Marvel comic characters such as Batman and Robin and their adversaries as character objects might be created and included with the accompanying combat sound effects supplied as word objects for use in comic fist fights. A political assembly including articulated magnetic figures of politicians as character objects might be produced for use in creating political cartoons that could be entered in a website where a weekly contest is held for the most clever political cartoon. Character objects could also be used as creative business cards.

Corporations could use various embodiments of the inventive articulated magnetic figure assemblies 10 for the promotion of their products. For example, a motion picture studio might make various embodiments of a film's lead characters (e.g., Jackie Chan or the animated characters from South Park) to help create interest around that film or television show and its characters on a day to day basis in consumers' homes.

Additionally, consumers can send digital images of themselves or other familiar persons or subjects, such as a family pet, taken on digital cameras to a company which then produces character objects from likenesses of those images.

Figure 13:
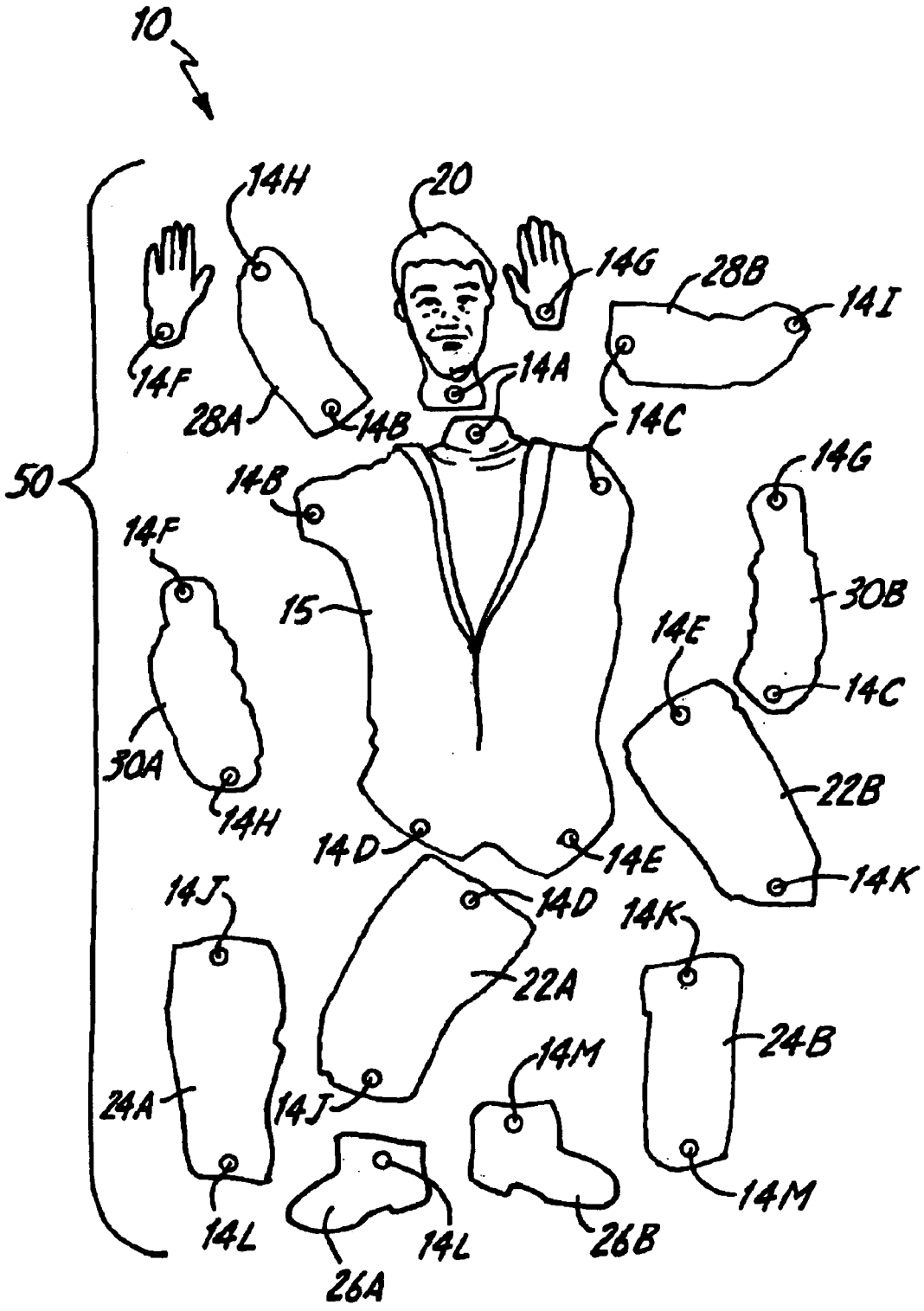
FIG. 13 is a plan view of an exploded fifth character object.

Using the additional character objects, accessory objects erasable word bubble objects and word objects together with the character objects of themselves, users can create comics of themselves and their friends and family or they can communicate simple messages to each other (e.g., "Please take the garbage out when you get home"). In this embodiment using pictures (e.g., digitized photographs), the character object created of the user might be full body or instead might simply be their head applied to any of a number of real or fictional characters (e.g., The President of the United States or Superman). A fifth character object 50 is shown in the exploded view of FIG. 13 illustrating this embodiment of the inventive concept. To create the fifth character object 50 a photograph is used as the artwork on the artistic layer 33B (as described with respect to FIG. 1A). Articulation points 14A–14M are disposed at the joints of the person in the photograph allowing articulation of the character object 50. Since the character object 50 can be articulated at the points where a human body is jointed, the user can position the fifth character object 50 (a picture of an actual person) into various life-like or comical situations and poses as described previously. Word bubble objects and word objects can then be added to imply speech by the character object 50. In this fashion, the user can position the character object of someone they know (who is depicted on the artistic layer) of the character object 50 into various humorous or educational situations.

Although various embodiments of character, word, word bubble and accessory objects have been illustrated and described above, it should be noted that other embodiments including various characters are contemplated. The inventive assembly 10 has the flexibility to allow the user to create a broad range of educational or comic situations by varying the artistic layer of the different objects.

Figure 14:
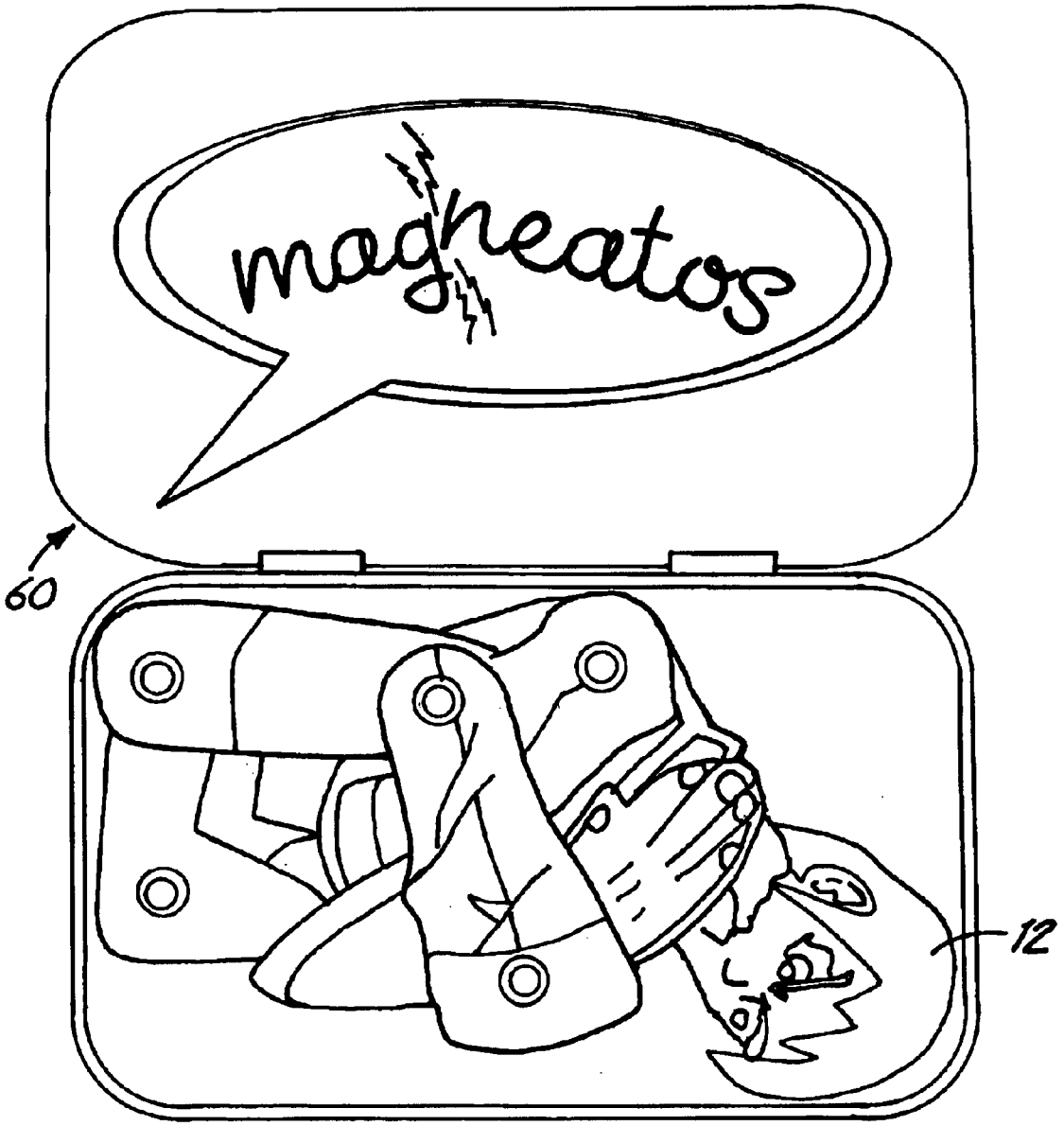
FIG. 14 is a plan view of the first character object in a case.

The invention is also a gaming system which can be provided in kit form. In one embodiment shown in FIG. 14, the kit includes a carrying case 60 into which one or more objects (e.g., character objects, accessory objects, word bubble objects, and word objects), as well as magnetic pivot fasteners may be inserted. The objects may be provided in assembled or disassembled form. The objects may be removed from the case 60 and deployed individually or juxtaposed with each other. While case 60 is illustrated as being a hinged metal box, other styles of carrying cases (such as plastic bags) are contemplated. The character objects can be articulated so as to be disposed in different poses by the user. These character objects can be used in conjunction with each other, with accessory objects, with word bubble objects and with word objects. Using the word bubble objects and/or the word objects creates a comic effect in which the user can position the character objects in a variety of poses and place word objects so that it appears the character object is speaking, being spoken to or being described. Accessory objects can be used to further the effect of a comic or educational situation of the character object. The order and meaning of the situation can be changed by reordering the word objects so as to create a new text message or by articulating the character objects into different poses or positions. The character objects can by mythical or imagined characters or alternatively may be real people. A photograph of a person may be converted into an articulated character object. All the objects of the kit may be magnetically adhereable to a ferric supporting surface.

Although the present invention has been described with reference to preferred embodiments, workers skilled in the art will recognize that changes may be made in form and detail without departing from the spirit and scope of the invention.

What is claimed is:

1. A character object comprising:

an artistic layer formed of sheet material including:

a torso having a plurality of articulation points;

a plurality of appendages, wherein each appendage is pivotally connected to the torso at one of the torso articulation points such that each appendage may be pivoted with respect to the torso; and magnets disposed at the articulation points.

2. The character object of claim 1 wherein the magnet has substantially the same shape as the artistic layer.

3. The character object of claim 1, wherein the magnets disposed at the articulation points comprise:

magnetic pivot fasteners.

4. The character object of claim 3, wherein each magnetic pivot fastener includes single annular plastic casing having a magnet secured internally in the casing and annular collars disposed annularly about the casing so as to secure each appendage to the torso.

5. The character object of claim 1 wherein the plurality of appendages comprise:

first and second leg appendages, wherein each of the first and second leg appendages has at least two articulated segments.

6. The character of claim 5 wherein the plurality of appendages comprise:

third and fourth leg appendages, wherein each of the third and fourth leg appendages has at least two articulated segments.

7. The character of claim 5 wherein the plurality of appendages comprise:

first and second arm appendages, wherein each of the first and second arm appendages has at least two articulated segments.

8. The character of claim 7 wherein each leg appendage has three articulated segments and each arm appendage has three articulated segments.

9. The character of claim 7 wherein the plurality of appendages comprise:

a head member.

10. A toy assembly comprising:

a character object including:

a torso formed of sheet material having a plurality of articulation points;

first and second leg appendages, wherein each of the first and second leg appendages has at least two articulation points;

first and second arm appendages, wherein each of the first and second arm appendages has at least two articulation points;

wherein each leg appendage and arm appendage is pivotally connected to the torso at one of the articulation points on the torso; and a magnetic pivot fastener disposed at each articulation point wherein each magnetic pivot fastener includes single annular plastic casing having a magnet secured internally in the casing and annular collars disposed annularly about the casing so as to secure each appendage to the torso.

11. The assembly of claim 10 and further comprising:

a plurality of word objects comprising:

a word surface formed of sheet material displaying a word selected from a list of parts of speech including nouns, adjectives, adverbs, verbs, pronouns, prepositions, prefixes, suffixes; and a first magnetic layer fixably attached to the word surface.

12. The assembly of claim 10 and further comprising:

a word bubble object formed of sheet material including a word object surface shaped so as to resemble a cartoon word balloon, so as to imply speech or thought; and a second magnetic layer fixably attached to the word object surface.

13. The assembly of claim 10 and further comprising:

an accessory object formed of sheet material including an accessory surface; and a third magnetic layer fixably attached to the accessory surface.

14. The assembly of claim 10, wherein the magnet has substantially the same shape as the torso, leg appendages and arm appendages.

15. The assembly of claim 10, wherein each articulation point includes a magnet pivot fastener.

16. A toy kit comprising:

a case;

a first character object including:

a torso formed of sheet material having a plurality of torso joints;

first and second leg appendages formed of sheet material pivotally connected to the torso wherein each of the first and second leg appendages is pivotally connected to the torso at one of the torso joints and has at least two articulated segments;

first and second arm appendages formed of sheet material wherein each of the first and second arm appendages is pivotally connected to the torso at one of the torso joints and has at least two articulated segments;

a head member formed of sheet material pivotally connected to the torso at one of the torso joints; and a first magnetic layer fixably attached to the torso, first and second leg appendages, first and second arm appendages and head member;

a first word bubble object including:

a word object surface formed of sheet material and shaped so as to resemble a cartoon word balloon; and a second magnetic layer fixably attached to the word object surface;

an accessory object including:

a first accessory surface formed of sheet material and shaped so as to resemble a tool; and a third magnetic layer fixably attached to the accessory surface.

17. The kit of claim 16 comprising:

a second character object substantially similar object substantially similar to the first character object.

18. The kit of claim 16 comprising:

a second word bubble object substantially similar to the first word bubble object.

19. The kit of claim 16 comprising:

a second accessory object substantially similar to the first accessory object.

* * * * *

UNITED STATES PATENT AND TRADEMARK OFFICE

CERTIFICATE OF CORRECTION

PATENT NO. : 6,712,667 B1
DATED : March 30, 2004
INVENTOR(S) : Eric R. Melzer et al.

It is certified that error appears in the above-identified patent and that said Letters Patent is hereby corrected as shown below:

Column 1,
Line 6, delete “Meizer”, insert -- Melzer --

Column 4,
Line 31, delete “annularcasing”, insert -- annular casing --

Column 6,
Line 8, delete “variations,”, insert -- variations. --

Column 12,
Lines 19-20, in the second occurrence, delete “object substantially similar”

Signed and Sealed this

First Day of February, 2005

JON W. DUDAS
*Director of the United States Patent and Trademark Office*